US009828883B2

(12) United States Patent
Schuster et al.

(10) Patent No.: US 9,828,883 B2
(45) Date of Patent: Nov. 28, 2017

(54) LIVE STEAM DETERMINATION OF AN EXPANSION ENGINE

(75) Inventors: Andreas Schuster, Tussenhausen (DE); Andreas Sichert, Munich (DE); Richard Aumann, Munich (DE)

(73) Assignee: ORCAN ENERGY AG, Munich (DE)

( * ) Notice: Subject to any disclaimer, the term of this patent is extended or adjusted under 35 U.S.C. 154(b) by 225 days.

(21) Appl. No.: 13/994,902

(22) PCT Filed: Dec. 21, 2011

(86) PCT No.: PCT/EP2011/006492
§ 371 (c)(1),
(2), (4) Date: May 25, 2016

(87) PCT Pub. No.: WO2012/084242
PCT Pub. Date: Jun. 28, 2012

(65) Prior Publication Data

US 2016/0356184 A1 Dec. 8, 2016

(30) Foreign Application Priority Data

Dec. 23, 2010 (EP) ..... 10016063

(51) Int. Cl.

| | |
|---|---|
| ***F01D 17/08*** | (2006.01) |
| ***F01K 13/02*** | (2006.01) |
| ***F01K 25/10*** | (2006.01) |
| ***F01K 11/02*** | (2006.01) |
| ***F01K 13/00*** | (2006.01) |

(52) U.S. Cl.
CPC ..... *F01K 13/02* (2013.01); *F01D 17/08* (2013.01); *F01K 11/02* (2013.01); *F01K 13/003* (2013.01); *F01K 25/10* (2013.01); *F05D 2220/31* (2013.01); *F05D 2220/72* (2013.01)

(58) Field of Classification Search
CPC ..... F01K 13/003; F01D 17/08; F01D 17/085
See application file for complete search history.

(56) References Cited

U.S. PATENT DOCUMENTS

| | | | |
|---|---|---|---|
| 4,549,503 | A | 10/1985 | Keyes, IV et al. |
| 4,827,429 | A | 5/1989 | Silvestri, Jr. |
| 5,003,782 | A | 4/1991 | Kucerija |

(Continued)

FOREIGN PATENT DOCUMENTS

| | | | |
|---|---|---|---|
| JP | 6419102 | A | 1/1989 |
| JP | 2003535251 | A | 11/2003 |

(Continued)

*Primary Examiner* — Jonathan Matthias
(74) *Attorney, Agent, or Firm* — Moore & Van Allen PLLC; Henry B. Ward, III

(57) ABSTRACT

The present invention provides a method for open-loop controlling or closed-loop controlling and/or monitoring a device with an expansion engine which is supplied live steam of a working medium that is expanded to exhaust steam in the expansion engine comprising the steps: determining at least one physical parameter of the exhaust steam; determining at least one physical parameter of the live steam based on the determined at least one physical parameter of the exhaust steam; and open-loop controlling or closed-loop controlling and/or monitoring the device based on the at least one determined physical parameter of the live steam. A thermal power plant is also provided in which the method is realized.

11 Claims, 1 Drawing Sheet

(56) References Cited

U.S. PATENT DOCUMENTS

| | | | | |
|---|---|---|---|---|
| 7,028,479 | B2 | 4/2006 | Gobrecht et al. | |
| 2003/0213245 | A1 | 11/2003 | Yates et al. | |
| 2004/0088984 | A1 | 5/2004 | Gobrecht et al. | |
| 2008/0006040 | A1 * | 1/2008 | Peterson ..... | B60H 1/3204 62/116 |

FOREIGN PATENT DOCUMENTS

| | | | |
|---|---|---|---|
| JP | 2011511209 | A | 4/2011 |
| WO | 0192689 | A1 | 12/2001 |
| WO | 2007008225 | A2 | 1/2007 |
| WO | 2009098471 | A2 | 8/2009 |

* cited by examiner

LIVE STEAM DETERMINATION OF AN EXPANSION ENGINE

FIELD OF THE INVENTION

The present invention relates to open-loop controlling or closed-loop controlling and/or monitoring a device with an expansion engine being supplied with live steam of a working medium which is expanded to exhaust steam in the expansion engine.

BACKGROUND OF THE INVENTION

Operation of expansion engines, such as steam turbines, and using the Organic Rankine Cycle (ORC) method for generating electrical energy by using organic media such as organic media with a low vaporization temperature, which at the same temperature generally have higher vaporizing pressures as compared with water as a working medium, is known in prior art. ORC systems represent realization of the Rankine cycle in which, for example, basically electrical energy is obtained by adiabatic and isobaric state changes of a working medium. Via vaporization, expansion and subsequent condensation of the working medium, mechanical energy is obtained and converted to electrical energy. In principle, the working medium is raised to operating pressure by a feed pump, and it is in a heat exchanger supplied with energy in the form of heat that is provided by combustion or a flow of waste heat. From the vaporizer, the working medium flows via a pressure pipe to an ORC-turbine where it is expanded to a lower pressure. Subsequently, the expanded working medium steam flows through a condenser in which there is a heat exchange between the vaporous working medium and a cooling medium, whereafter the condensed working medium is returned by a feed pump to the vaporizer in a cyclic process.

Precise monitoring and controlling of the expansion engine is essential for efficient operation and is a particular challenge depending on the working medium and its thermodynamic parameters. In this, determining the physical parameters of the live steam of the working medium supplied to the expansion engine is of particular importance. Conventionally, the live steam parameters, such as the live steam entropy and the live steam enthalpy, are determined as functions of the determined temperature and/or the determined pressure of the live steam. In ORC-systems, however, it can be advantageous with regard to their degree of efficiency, that at the beginning of the expansion of the working medium in the expansion engine, this medium is present in a two-phase state.

If the working medium in the heat exchanger is only partially vaporized, then the enthalpy can not be directly determined from the pressure and the temperature of the partially vaporized working medium because the wet steam region of the live steam enthalpy and entropy is, in addition to the pressure and/or the temperature, also dependent on the steam content.

However, the steam content can not easily be determined. If, on the other hand, the expansion engine is operated with a working medium in the supercritical region near the critical point, in the vicinity of which the density of the steam and the liquid asymptotically approach each other at the same temperature, then the live steam parameters can be determined only with great inaccuracy from the pressure and/or the temperature because the isobars at the critical point run approximately horizontally. Near the critical point, even very small changes in temperature lead to very large enthalpy and entropy changes.

There is therefore a need, and it is therefore the object of the present invention, to in a reliable manner open-loop control or closed-loop control or monitor, respectively, the open-loop controlling or closed-loop controlling of an expansion engine being acted upon by a two-phase working medium such that the above-mentioned problems can be overcome.

BRIEF SUMMARY OF THE INVENTION

The above-mentioned object is satisfied by a method for open-loop controlling or closed-loop controlling and/or monitoring a device having an expansion engine according to claim 1, wherein the expansion engine is supplied with live steam of a working medium which is expanded to exhaust steam in the expansion engine, the method comprising the steps of:

determining at least n physical parameter of the exhaust steam;

determining at least one physical parameter of the live steam based on the determined at least one physical parameter of the exhaust steam; and open-loop controlling or closed-loop controlling and/or monitoring the device on the basis of the at least one determined physical parameter of the live steam.

One characteristic of the present invention is that parameters (magnitude) obtained for the exhaust steam are used to determine parameters (magnitude) of the live steam, which are of relevance for open-loop/closed-loop controlling or monitoring the device. This bypasses or avoids the above-mentioned problems of the technically impossible or inaccurate determination of the live steam parameters based on the temperature and the pressure, especially in the wet steam region or with supercritical steam parameters.

The device can comprise in particular apparatuses for supplying live steam to the expansion engine and closed-loop controlling/open-loop controlling/monitoring can comprise in particular closed-loop controlling/open-loop controlling/monitoring the live steam to the expansion engine. The device can in particular be part of a steam power plant or be a steam power plant, in which the working medium after passing through a vaporizer is fed to the expansion engine, which can in particular be a turbine. For example, this can comprise the device, the vaporizer as well as supply apparatuses to the vaporizer and to the expansion engine. The device can further comprise a condenser for condensing the exhaust steam, and a feed pump for supplying the liquefied working medium to the vaporizer. Open-loop controlling/closed-loop controlling can therefore relate overall to open-loop controlling/closed-loop controlling transport of the working medium in the device, where in particular the mass flow rate of the working medium can be open-loop controlled/closed-loop controlled, for example, by respectively controlling the feed pump. Operation of the expansion engine and/or the vaporizer can also according to the method of the invention be open-loop controlled/closed-loop controlled based on the at least one determined physical parameter of the live steam.

The working medium can in particular be an organic medium which is vaporized in a vaporizer in the framework of an Organic Rankine Cycle (ORC)—process and is then supplied to the expansion engine. The method according to the invention is of particular importance for ORC-systems, since the working medium can advantageously be supplied to the expansion engine in a biphasic manner or in particular in the supercritical region, but near the critical point, in the vicinity of which the density of the liquid phase and the gaseous phase of the working medium approach each other asymptotically.

According to a further embodiment of the method according to the invention, the isentropic degree of efficiency of the expansion engine is determined and the at least one physical parameter of the live steam is determined based on the determined degree of efficiency of the expansion engine, i.e after determining (e.g. measuring) parameters of the exhaust steam, while having knowledge of the determined degree of efficiency of the expansion engine, conclusions can be drawn regarding the parameters relevant for open-loop controlling/closed-loop controlling/monitoring. The state of the live steam is therefore determined from the state of the exhaust steam. For this, the isentropic degree of efficiency of the expansion engine is required. Due to the fact, however, that it depends on the state of the exhaust steam, an iterative approach is needed.

In this context, the method can include the step of determining the compression ratio of the working medium applied to the expansion engine and the mass flow of the working medium. In this case, the isentropic degree of efficiency of the expansion engine is determined based on the determined compression ratio applied to the working medium and the mass flow of the working medium. Depending on the design of the expansion engine, the isentropic degree of efficiency can depend of the rotational speed of the expansion engine. Therefore, the method can further comprise the step of determining the rotational speed of the expansion engine, and in this case, the isentropic degree of efficiency of the expansion engine is determined based on the determined rotational speed of the expansion engine. This is particularly advantageous if the expansion engine is a piston expansion engine, a scroll expander or a screw expander.

In each of these examples mentioned, the method can comprise modeling the operation of the expansion engine with the working medium based on thermodynamic equations and empirically determined parameters values and the degree of efficiency of the expansion engine can be determined based on the result of modeling the operation of the expansion engine.

The at least one determined physical parameter of the live steam that is used for open-loop controlling/closed-loop controlling/monitoring the device can comprise the temperature and/or the (specific) enthalpy and/or (specific) entropy and/or the volume ratio from the gaseous to the liquid phase and/or the density ratio from the gaseous to the liquid phase of the live steam. In particular, the steam content, being the quotient of the mass of the steam portion and the total mass, as well as the temperature of the live steam, and using that, the entropy/enthalpy of same can be deduced. Particularly suitable parameters for the live steam are thus obtained for open-loop controlling/closed-loop controlling/monitoring.

The at least one determined physical parameter of the exhaust steam can comprise the temperature and/or the pressure of the same. In particular, the step of determining the temperature of the live steam can be performed based on the determined temperature and the determined pressure of the exhaust steam.

According to a further development, the method according to the invention comprises the step of determining for example, of measuring) the pressure of the live steam which differs from the at least one determined physical parameter of the live steam being determined based on the at least one determined physical parameter of the exhaust steam, and the least one physical parameter of the live steam is determined based on the determined pressure (differing from this parameter) of the live steam.

As already mentioned, an organic working medium can be provided as the working medium and the expansion engine can be operated within the framework of an Organic Rankine Cycle (ORC) process for generating electrical energy. In this, the live steam of the organic working medium can be in the supercritical state or in the wet steam region. All "dry media" used in conventional ORC-systems can come into consideration as working media, such as R245fa, and "wet" media, such as ethanol or "isentropic media" such as R134a. Silicone-based synthetic working media can also be used, such as GL 160. The device can be a steam power plant, in particular an Organic Rankine Cycle steam power plant, or a component thereof. The ORC-plant itself can for example, be a geothermal or solar thermal plant or can also comprise burning fossil fuels as a heat source.

In the above-mentioned examples, the parameter of the exhaust steam can be determined by measuring at respective measuring points of the device.

Furthermore, for satisfying the above object, the present invention provides a thermal power plant comprising:

an expansion engine which is supplied live steam of a working medium that is expanded in the expansion engine to exhaust steam, and an open-loop control or closed-loop control device;

where said open-loop control or closed-loop control device is designed for determining at least one physical parameter of the exhaust steam;

for determining at least one physical parameter of the live steam based on the determined at least one physical parameter of the exhaust steam; and for open-loop controlling or closed-loop controlling and/or monitoring the thermal power plant based of the at least one determined physical parameter of the live steam.

All specifications relating to the working medium and the nature of the physical parameters as well as to the determination thereof, as described in the above examples of the method according to the invention, can be implemented in further developments of the thermal power plant. The thermal power plant can in particular be an ORC-power plant, in which an organic working medium is vaporized in a heat exchanger and then supplied to the expansion engine to be liquefied after expansion using a condenser and to again be supplied to the heat exchanger by a feed pump in the framework of an ORC circuit. In this, the heat exchanger can be acted upon by smoke that is produced, for example, by burning fossil fuels.

BRIEF DESCRIPTION OF THE DRAWINGS

Further features and embodiments as well as advantages of the present invention are by way of example illustrated below using the drawings. It is understood that the embodiments do not exhaust the scope of the present invention. It is further understood that some or all features described hereafter can also be combined in other ways.

DETAILED DESCRIPTIONS OF THE INVENTION

Figure 1:
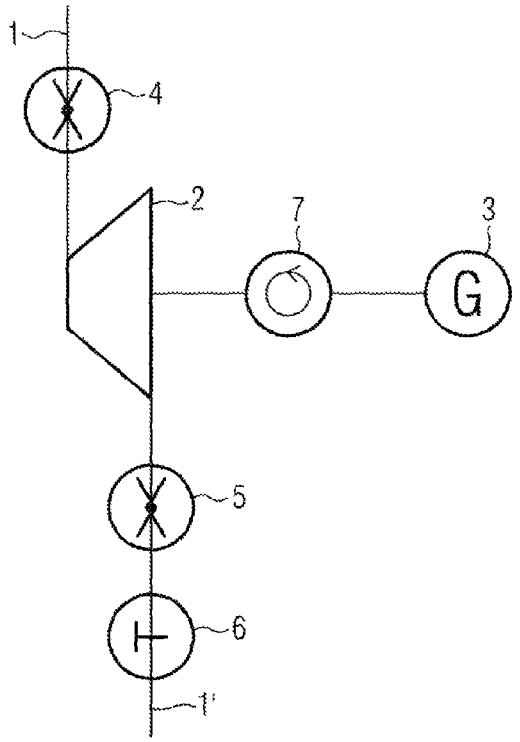
FIG. 1 illustrates measuring points for determining physical parameters used for determining physical parameters of the live steam differing therefrom according to one example of the method according to the invention.

According to the present invention, at least one physical parameter of the exhaust steam is determined in order, by means of it, to determine physical parameters of the live steam. As shown in FIG. 1, the pressure and the temperature of the exhaust steam are according to one embodiment measured at measuring points or obtained directly as information from the controller, namely, power electronics/process measuring and control technology (MSR). A working medium in the form of live steam, 1 is supplied to an expansion engine 2, such as a turbine, and mechanical energy gained by the expansion of the live steam of the working medium is by a generator converted into electrical energy 3.

FIG. 1 additionally shows measurement points for measuring various parameters. On the one hand, the pressure of the live steam 1 is measured, according to the example shown, at a live steam pressure measuring point 4. The exhaust steam pressure measuring point 6 and the exhaust steam temperature measuring point 6 provide the pressure and the temperature, respectively, of the expanded exhaust steam 1' of the working medium. Moreover, the rotational speed of the expansion engine is measured at the measuring point 7. From the measurement data thus obtained, the isentropic degree of efficiency of the expansion engine and physical parameters of the live steam required for open-loop controlling or closed-loop controlling, for example, the supply of live steam to the expansion engine, can be determined. For example, the temperature, the enthalpy or the volume ratio from the gaseous to the liquid phase and/or the steam content (quotient of the mass of the steam portion and the total mass) or the density ratio from the gaseous to the liquid phase of the live steam can be determined using the parameters measured at the measuring points 4 to 7. Determining the physical parameters of the live steam allows in particular open-loop controlling or closed-loop controlling the mass flow of the working medium to a heat exchanger (vaporizer), such that only just saturated steam is reached at the end of the expansion process.

Figure 2:
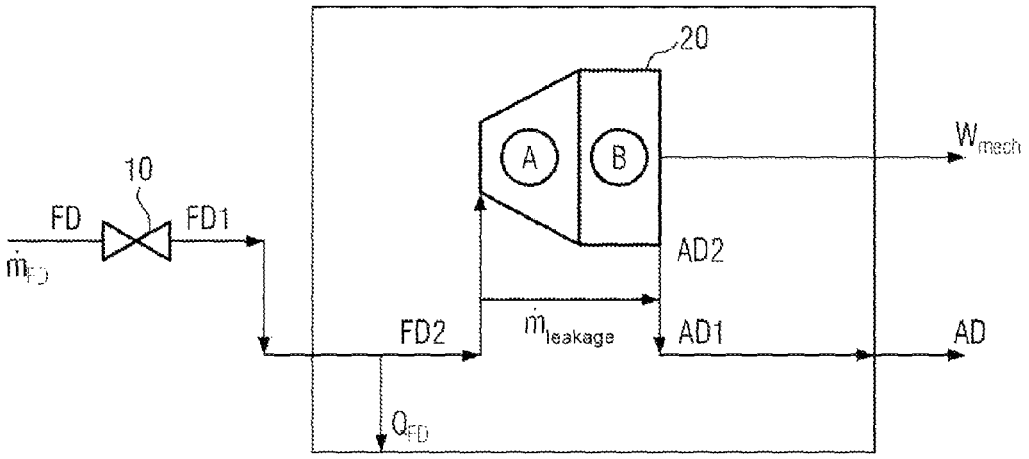
FIG. 2 illustrates the modeling of an expansion engine for determining the degree of efficiency of the same and ultimately of live steam parameters from determined exhaust steam parameters according to one example of the method according to the invention

FIG. 2 illustrates an example of the invention for semi-empirical modeling of an expansion engine, by which determination of relevant physical parameters of the live steam is enabled by way of example based on determining physical parameters of the exhaust steam. For this purpose, the flow of the working medium through the expansion engine is divided into different types of changes in state of the same, which are determined by different parameters.

In the example shown, the expansion engine can be modeled using seven parameters to be determined empirically.

First, there is an adiabatic pressure drop 10 of the live steam (FD→FD1) of the working medium, which is supplied with the mass rate $\dot{m}_{FD}$, at the inlet of expansion engine. This adiabatic pressure drop 10 is substantially determined by the inlet cross section, which is thereby used as the first empirical parameter for modeling. Isobaric cooling (FD1→FD2) of the working medium as the second empirical parameter occurs according to the heat transfer capacity of the live steam. The working medium then undergoes 20 in a first stage A an isentropic expansion according to the built-in volume ratio, which is to be considered as a third empirical parameter. Volumetrically operating expansion engines have a so-called built-in volume ratio. Steam is enclosed in a chamber and expanded and ejected after opening the chamber. The volume ratio is the quotient of the volume of steam when opening the chamber and the volume of steam when closing the chamber.

Design-related post-expansion or return-compression of the exhaust steam (→AD2) is considered in a second stage B.

Depending on the heat transfer capacity of the exhaust steam as the fourth empirical parameters, there it is then either a warming or cooling of the expanded steam (AD2→AD1). Contributing to the flow of the working medium after expansion is also a portion of the live steam after isobaric cooling (FD2), which, as a leakage mass flow having the rate $\dot{m}_{leakage}$ according to a leakage cross-section as a fifth empirical parameter, flows past the expansion stage. For this leakage mass flow, the heat loss $\dot{Q}_{FD}$ is via the isothermal casing of the expansion engine according to the heat-transfer capacity of the isobaric cooled live steam (FD2) to be considered as the sixth empirical parameter Finally, a mechanical torque loss $\underline{\dot{W}}_{mech}$ of the expansion engine is considered as the seventh empirical parameter. The working medium finally exits the expansion engine as exhaust steam AD.

For determining the empirical parameters, measurement values are recorded in relevant areas of operation. The isentropic degree of efficiency of the expansion engine can for different rotational speeds then be determined from the live steam pressure and the exhaust steam parameters, as determined, for example, according to FIG. 1, on the basis of thermodynamic model equations, which the person skilled in the art is familiar with. Using the determined degree of efficiency, the relevant live steam parameters such as entropy and enthalpy or temperature can then be deduced.

Specifically, the following iterative method suggests itself for determining the relevant live steam parameters. In a first step, the pressure and temperature of the exhaust steam are determined, for example, measured. From this, the entropy of the exhaust steam can be determined. In a second step, live steam parameters, such as live steam temperature, steam content of the live steam and the entropy of the same, are determined by using an initial value for the isentropic degree of efficiency $\eta(1)$. In a third step, the iterated isentropic degree of efficiency $\eta(1+n)$ is determined using the rotational speed; the steam content of the live steam and the temperatures and pressures of both the live steam and the exhaust steam, In the fourth step, the new values for the live steam parameters, such as the live steam temperature, the steam content of the live steam and the entropy of the same are, now to be determined using the iterated isentropic degree of efficiency $\eta(1+n)$. Steps 3 and 4 are to be iterated until a desired predetermined accuracy for the live steam parameters to be determined has been reached.

The isentropic degree of efficiency generally depends on several parameters. It can be determined as a function of the rotational speed, the live steam parameters, the exhaust steam parameters, but also the geometry of the expansion engine, as the person skilled in the art knows. The isentropic degree of efficiency can be determined, for example, by numerical simulation, in particular, by fluidic simulation calculations. Alternatively, it can be determined empirically by a smoothing function based on measurement values or semi-empirically by parameterization of conditional equations, where parameters are generated from measurement values. These methods for determining the isentropic degree of efficiency are well known to the person skilled in the art.

The invention claimed is:

1. A method for open-loop controlling or closed-loop controlling and/or monitoring a device having an expansion engine, the method comprising:

supplying said expansion engine with live steam of an organic working medium in a supercritical state or in a wet steam region that is expanded to exhaust steam in said expansion engine;

determining at least one physical parameter of said exhaust steam;

determining an isentropic degree of efficiency of said expansion engine;

determining at least one physical parameter of said live steam based on the determined at least one physical parameter of said exhaust steam and the determined isentropic degree of efficiency;

open-loop controlling or closed-loop controlling and/or monitoring said device based on said at least one determined physical parameter of said live steam; and operating said device within a framework of an Organic Rankine Cycle (ORC) process for generating electrical energy.

2. The method according to claim 1, further comprising the step of determining a compression ratio of said organic working medium applied to said expansion engine and a mass flow of said organic working medium, and in which said isentropic degree of efficiency of said expansion engine is determined based on the determined applied compression ratio of said organic working medium and the mass flow of said organic working medium.

3. The method according to claim 1, in which said expansion engine is a displacement engine, and further comprising the step of determining a rotational speed of said expansion engine, and in which the isentropic degree of efficiency of said expansion engine is determined based on said determined rotational speed of said expansion engine.

4. The method according to claim 3, wherein supplying said expansion engine further comprises supplying said expansion engine defined as one of a piston expansion engine, a scroll expander or a screw expander.

5. The method according to claim 1, comprising the step of modeling an operation of said expansion engine with said organic working medium based on thermodynamic equations and empirically determined parameters values, and in which said isentropic degree of efficiency of said expansion engine is determined based on a result of modeling the operation of said expansion engine.

6. The method according to claim 1, in which said at least one determined physical parameter of said exhaust steam comprises a temperature and/or a pressure of said exhaust steam.

7. The method according to claim 6, comprising the step of determining a temperature of said live steam based on the determined temperature and the determined pressure of said exhaust steam.

8. The method according to claim 1, further comprising the step of determining a pressure of said live steam which differs from said at least one determined physical parameter of said live steam being determined based on said at least one determined physical parameter of said exhaust steam, and in which said at least one physical parameter of said live steam is determined based on said determined pressure of said live steam.

9. The method according to claim 1, in which said at least one determined physical parameter of said live steam comprises a temperature and/or an enthalpy and/or an entropy and/or a volume ratio of a gaseous to a liquid phase and/or a steam content and/or a density ratio of the gaseous to the liquid phase of said live steam.

10. The method according to claim 1, wherein operating said device further comprises operating said device, wherein said device is a steam power plant or a component thereof.

11. A thermal power plant, comprising:

an expansion engine operated within a framework of an Organic Rankine Cycle (ORC) process for generating electrical energy, which is supplied live steam of an organic working medium in a supercritical state or in a wet steam region that is expanded to exhaust steam in said expansion engine; and an open-loop or closed-loop controller configured to:

determine at least one physical parameter of said exhaust steam;

determine an isentropic degree of efficiency of said expansion engine;

determine at least one physical parameter of said live steam based on said determined at least one physical parameter of said exhaust steam and the determined isentropic degree of efficiency; and open-loop control or closed-loop control and/or monitoring said thermal power plant based on said at least one determined physical parameter of said live steam.

* * * * *